US007762072B2

(12) United States Patent
Critchley et al.

(10) Patent No.: US 7,762,072 B2
(45) Date of Patent: Jul. 27, 2010

(54) COMBUSTION SYSTEMS WITH ROTARY FUEL SLINGERS

(75) Inventors: Ian L. Critchley, Phoenix, AZ (US); Paul R. Yankowich, Phoenix, AZ (US); Kenneth R. Tyrer, Queen Creek, AZ (US)

(73) Assignee: Honeywell International Inc., Morristown, NJ (US)

( * ) Notice: Subject to any disclaimer, the term of this patent is extended or adjusted under 35 U.S.C. 154(b) by 862 days.

(21) Appl. No.: 11/653,495

(22) Filed: Jan. 16, 2007

(65) Prior Publication Data

US 2008/0171294 A1 Jul. 17, 2008

(51) Int. Cl.
*F02C 1/00* (2006.01)
*F02G 3/00* (2006.01)

(52) U.S. Cl. ..... 60/744; 60/752; 60/745

(58) Field of Classification Search ..... 60/734, 60/740, 741, 742, 746, 747, 752–760, 804, 60/744, 745
See application file for complete search history.

(56) References Cited

U.S. PATENT DOCUMENTS 2,856,755 A * 10/1958 Szydlowski ..... 60/804
3,102,393 A 9/1963 Clare
3,204,408 A * 9/1965 Vincent ..... 60/745
3,263,978 A 8/1966 Safford
3,695,037 A 10/1972 Alverani
3,921,393 A 11/1975 Bracken, Jr.
3,932,988 A 1/1976 Beaufrere
3,933,133 A 1/1976 Shekleton
3,983,694 A 10/1976 Bracken, Jr.
4,038,815 A * 8/1977 Heitmann et al. ..... 60/39.08
4,040,251 A 8/1977 Heitmann et al.
4,180,974 A 1/1980 Stenger et al.
4,232,526 A * 11/1980 Barbeau ..... 60/745
4,255,935 A * 3/1981 Morishita ..... 60/745
4,257,236 A * 3/1981 Morishita ..... 60/745
4,478,045 A 10/1984 Shekleton
4,597,260 A * 7/1986 Balsley et al. ..... 60/39.827
4,598,544 A 7/1986 Williams et al.
4,769,996 A 9/1988 Barbeau (Continued)

FOREIGN PATENT DOCUMENTS

EP 1121561 8/2001

(Continued)

*Primary Examiner*—William H Rodríguez
(74) *Attorney, Agent, or Firm*—Ingrassia Fisher & Lorenz, P.C.

(57) ABSTRACT

A combustion system includes a fuel manifold adapted to receive a flow of fuel from a fuel source, the fuel manifold including at least one orifice from which the received fuel is discharged. The combustion system further includes a rotary fuel slinger disposed adjacent to the fuel manifold. The rotary fuel slinger includes a coupler shaft and a slinger disc coupled to the coupler shaft. The slinger disc includes a first portion disposed generally perpendicular to the coupler shaft and a second portion disposed at an angle to the first portion. The fuel manifold is positioned relative to the rotary fuel slinger such that the discharged fuel impinges on the second portion. The rotary fuel slinger is configured to rotate such that the flow of fuel is centrifuged radially outwardly from the second portion onto the first portion and subsequently off the rotary fuel slinger to atomize the received fuel.

17 Claims, 4 Drawing Sheets

U.S. PATENT DOCUMENTS

| | | | | |
|---|---|---|---|---|
| 4,819,424 | A | 4/1989 | Bak | |
| 4,870,825 | A | 10/1989 | Chapman | |
| 4,974,416 | A | 12/1990 | Taylor | |
| 4,996,838 | A | 3/1991 | Melconian | |
| 5,265,425 | A | 11/1993 | Howell | |
| 5,323,602 | A | 6/1994 | Defever | |
| 5,526,640 | A | 6/1996 | Brooks et al. | |
| 6,148,617 | A * | 11/2000 | Williams | 60/737 |
| 6,786,430 | B2 | 9/2004 | Hayashi | |
| 6,886,341 | B2 | 5/2005 | Inoue et al. | |
| 6,983,606 | B2 | 1/2006 | Brown | |
| 7,036,321 | B2 | 5/2006 | Dudebout et al. | |
| 2005/0097889 | A1 | 5/2005 | Pilatis et al. | |
| 2005/0229601 | A1 | 10/2005 | Thompson, Jr. et al. | |
| 2008/0184707 | A1 * | 8/2008 | Zupanc et al. | 60/745 |
| 2009/0071161 | A1 * | 3/2009 | Critchley et al. | 60/754 |

FOREIGN PATENT DOCUMENTS

| | | |
|---|---|---|
| WO | WO0057048 | 9/2000 |

* cited by examiner

COMBUSTION SYSTEMS WITH ROTARY FUEL SLINGERS

FIELD OF THE INVENTION

The present invention generally relates to combustion systems, and more particularly relates to combustion systems with rotary fuel slingers.

BACKGROUND OF THE INVENTION

Combustion systems in gas turbine engines typically ignite and combust an air and fuel mixture to drive a turbine. The combustion system can include a fuel manifold that supplies a stream of fuel to a rotary fuel slinger that atomizes the fuel. The atomized fuel is then mixed with air in the combustion chamber and ignited by an igniter. The efficiency of atomization impacts the efficiency of the combustion system and the engine overall. Typically, the stream of fuel can impact the rotary fuel slinger and splatter. The splattered fuel results in a loss of control of the fuel and additionally results in a portion of the fuel not being atomized. These conditions can adversely impact the effectiveness of the gas turbine engine, and additionally result in fuel contamination in the areas surrounding the fuel manifold.

Accordingly, it is desirable to provide improved combustion systems. In addition, it is desirable to provide rotary fuel slingers for combustion systems that reduce splattering of the fuel stream impacting the rotary fuel slinger. It is also desirable to provide improved methods of atomizing a flow of fuel from a fuel manifold by a rotary fuel slinger. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

In accordance with an exemplary embodiment of the invention, a combustion system can include a fuel manifold adapted to receive a flow of fuel from a fuel source, the fuel manifold including at least one orifice from which the received fuel is discharged. The combustion system further includes a rotary fuel slinger disposed adjacent to the fuel manifold. The rotary fuel slinger includes a coupler shaft and a slinger disc coupled to the coupler shaft. The slinger disc includes a first portion disposed generally perpendicular to the coupler shaft and a second portion disposed at an angle to the first portion. The fuel manifold is positioned relative to the rotary fuel slinger such that the discharged fuel impinges on the second portion. The rotary fuel slinger is configured to rotate such that the flow of fuel is centrifuged radially outwardly from the second portion onto the first portion and subsequently off the rotary fuel slinger to atomize the fuel. The combustion system further includes a combustor including at least a forward annular liner and an aft annular liner spaced apart from one another to form a combustion chamber therebetween that receives the atomized fuel from the rotary fuel slinger, the forward and aft radial liners each including a plurality of openings for receiving compressed air into the combustion chamber to mix with the atomized fuel. The combustion system further includes an igniter extending at least partially into the combustion chamber and configured to ignite the atomized fuel and the compressed air mixture.

In accordance with another exemplary embodiment of the invention, a rotary fuel slinger is provided to be utilized in a combustion system having a fuel manifold. The rotary fuel slinger includes a coupler shaft and a slinger disc disposed on the coupler shaft. The slinger disc includes a first portion disposed generally perpendicular to the coupler shaft and a second portion having a curved segment with a radius of curvature greater than 0.3. The second portion is configured to receive a flow of fuel from the fuel manifold such that the flow of fuel is centrifuged radially outwardly from the second portion onto the first portion and subsequently off the rotary fuel slinger to atomize the received fuel. The rotary fuel slinger is configured such that the flow of fuel impinges upon the second portion at a first radial circumference during a first revolution and flows radially outwardly from the first radial circumference prior to a second revolution.

In accordance with a further exemplary embodiment of the invention, a method is provided for atomizing a flow of fuel from a fuel manifold with a rotary fuel slinger. The method includes delivering a flow of fuel to an angled portion of a rotary fuel slinger, the rotary fuel slinger being generally disposed perpendicularly to the flow of fuel. The method further includes centrifuging the flow of fuel radially outwardly from the angled portion to a relatively flat portion of the rotary fuel slinger, and then off the rotary fuel slinger to atomize the flow fuel.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

In accordance with one embodiment of the present invention, improved combustion systems are provided. The combustion systems can include rotary fuel slingers that reduce splattering of the fuel stream impacting the rotary fuel slinger. Moreover, improved methods of atomizing a flow of fuel from a fuel manifold by a rotary fuel slinger are provided in accordance with exemplary embodiments of the present invention.

Figure 1:
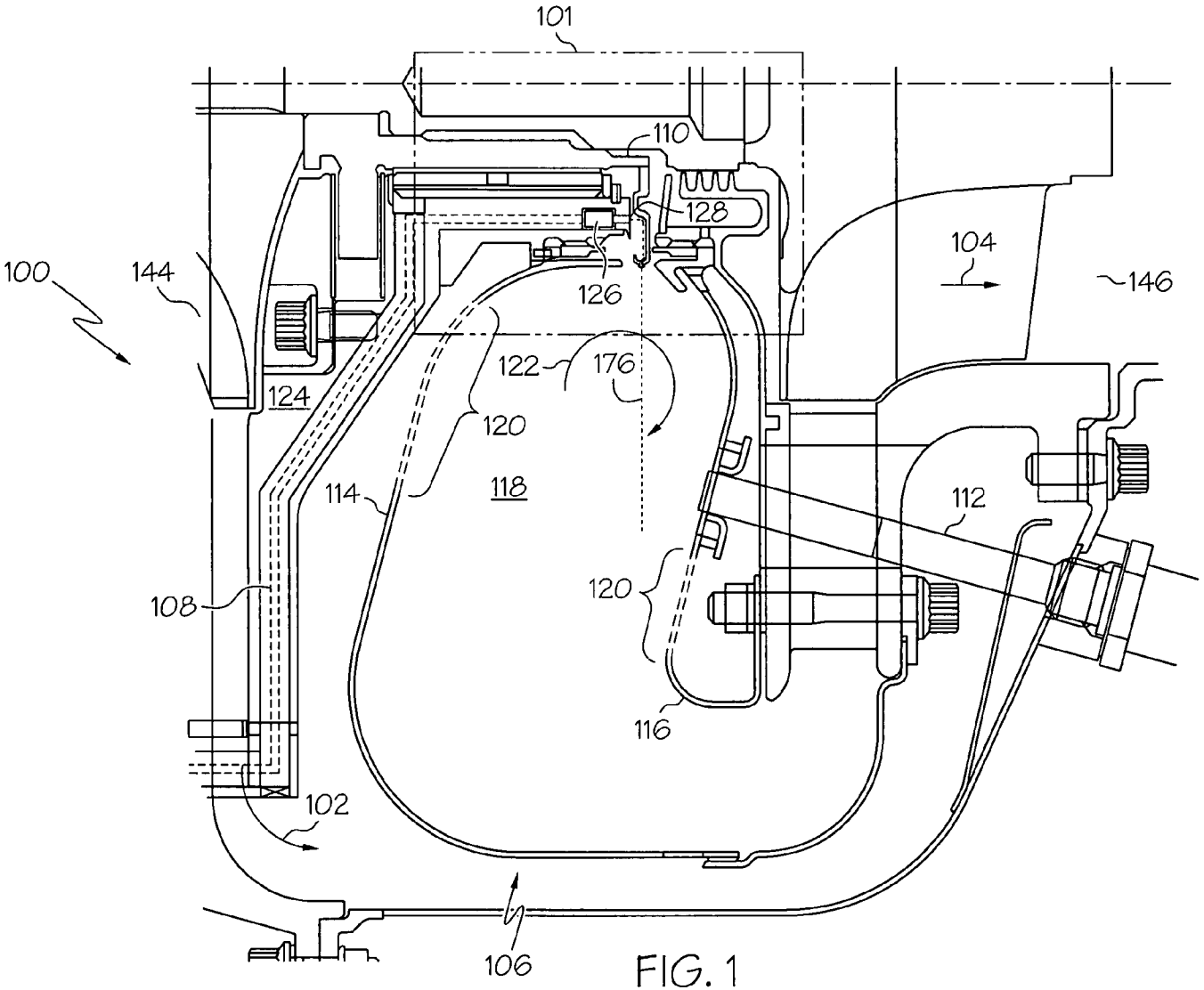
FIG. 1 is a cross sectional view of a combustion system in accordance with an exemplary embodiment of the present invention.
Figure 2:
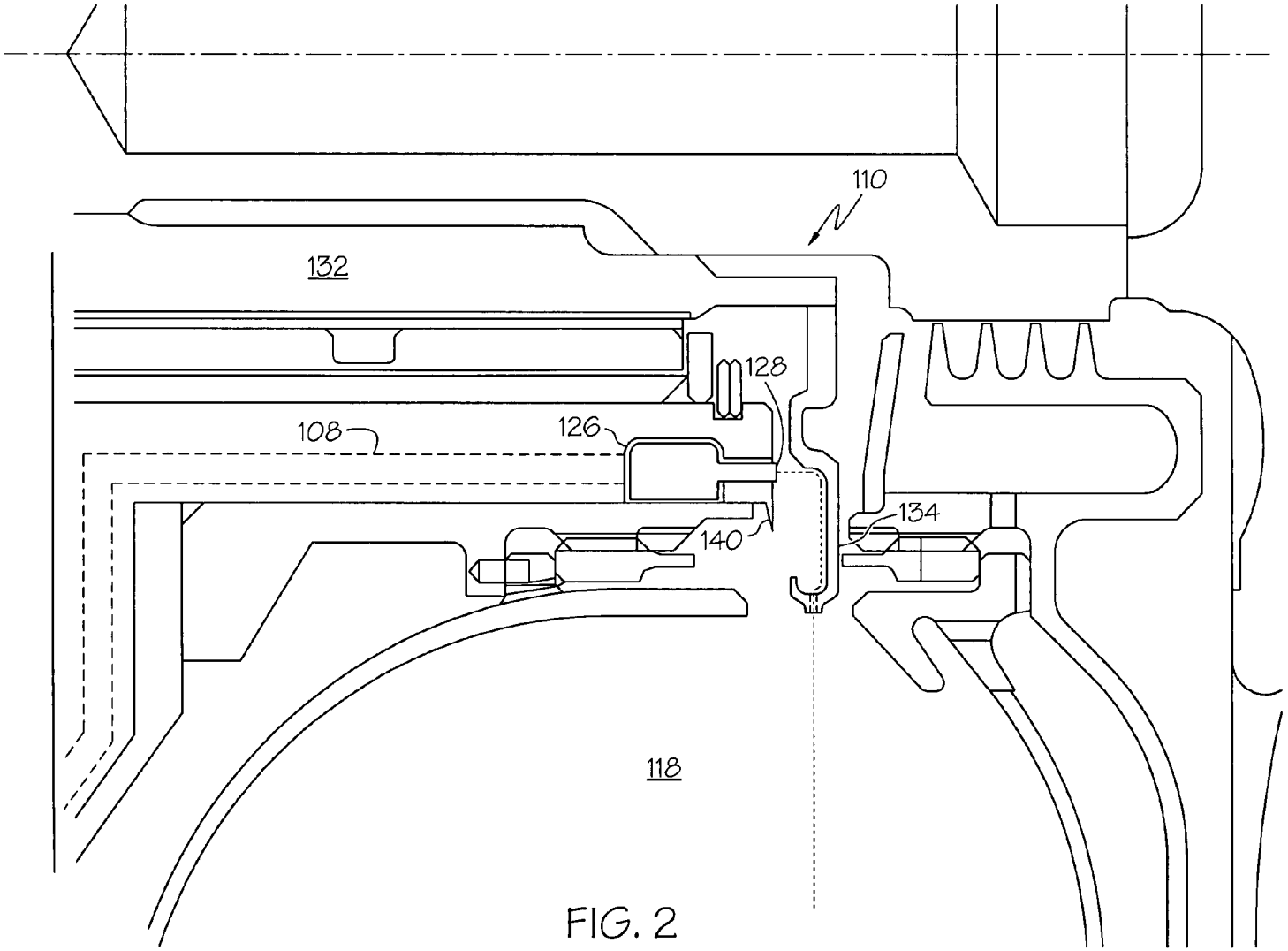
FIG. 2 is a close-up view of a portion of the combustion system of FIG. 1.

FIG. 1 is a cross sectional view of a combustion system 100 in accordance with an exemplary embodiment of the present invention, and FIG. 2 is a close-up view of a portion of the combustion system 100 indicated by box 101. In an exemplary embodiment, the combustion system 100 is an auxiliary power unit (APU) for an aircraft. The combustion system 100 receives compressed air 102 from a partially shown compressor 144, where it is mixed with fuel supplied from a fuel source (not shown). In the combustion system 100, the fuel/air mixture is combusted to generate high-energy gas 104. The high-energy gas 104 is then diluted and supplied to the turbine 146. The diluted, high-energy gas 104 from the combustion system 100 expands through the turbine, where it gives up much of its energy and causes the turbine 146 to rotate. As the turbine 146 rotates, it drives various types of equipment (not shown) that may be mounted in, or coupled to, the engine.

The combustion system 100 includes a combustor 106, a fuel supply tube 108, a rotary fuel slinger 110, and an igniter 112. The combustor 106 can be a radial-annular combustor, and include a forward annular liner 114, and an aft annular liner 116. The forward and aft annular liners 114, 116 are spaced apart from one another and form a combustion chamber 118. The forward and aft annular liners 114, 116 each include a plurality of air inlet orifices 120, and a plurality of effusion cooling holes (not shown). As noted above, compressed air 102 from the compressor 144 flows into the combustion chamber 118 via the air inlet orifices 120 in both the forward and aft annular liners 114, 116. The air inlet orifices 120 can be configured to generate a single toroidal recirculation flow pattern 122 in the combustion chamber 118.

The fuel supply tube 108 extends into a plenum 124 just forward of the combustor 106 and is adapted to receive a flow of fuel from the fuel source, for example, via diffuser vanes (not shown). The fuel supplied to the fuel supply tube 108 passes through the fuel supply tube 108, and is directed into a fuel manifold 126. In the depicted embodiment, the fuel manifold 126 has a housing defining a circumferential cavity, although it will be appreciated that other configurations could also be used. The fuel manifold 126 includes an end face with a plurality of fuel orifices 128 formed therein, through which the fuel is delivered to the rotary fuel slinger 110. Although not necessarily, the fuel orifices 128 can be equally spaced. In an exemplary embodiment, the fuel supply tube 108 only supplies liquid fuel to the fuel manifold 126. A fuel drip guide 140 can be provided on the end of the fuel manifold 126, to guide fuel from the fuel orifices 128 onto the rotary fuel slinger 110, particularly during low flow conditions. In an exemplary embodiment, the fuel drip guide 140 is a knife-edge drip guide and extends around the circumference of the fuel manifold 126.

The rotary fuel slinger 110, which is shown more clearly in FIG. 2, includes a coupler shaft 132 and a slinger disc 134. The coupler shaft 132 can be coupled to the turbine shaft (not shown) and rotate therewith. The slinger disc 134 can be coupled to the coupler shaft 132 and thus rotate with the coupler shaft 132. The fuel exits through the fuel orifices 128 in the fuel manifold 126 and impinges onto the slinger disc 134. Because the slinger disc 134 rotates with the coupler shaft 132, the impinging fuel acquires the tangential velocity of the coupler shaft 132 and is centrifuged off the slinger disc 134, as is described in greater detail below with reference to FIGS. 3-5.

The igniter 112 extends through the aft annular liner 116 and partially into the combustion chamber 118. The igniter 112, which may be any one of numerous types of igniters, is adapted to receive energy from an exciter (not shown) in response to the exciter receiving an ignition command from an external source, such as an engine controller (not shown). In response to the ignition command, the igniter 112 generates a spark of suitable energy, which ignites the fuel-air mixture in the combustion chamber 118, and generates the high-energy combusted gas that is supplied to the turbine.

Figure 3:
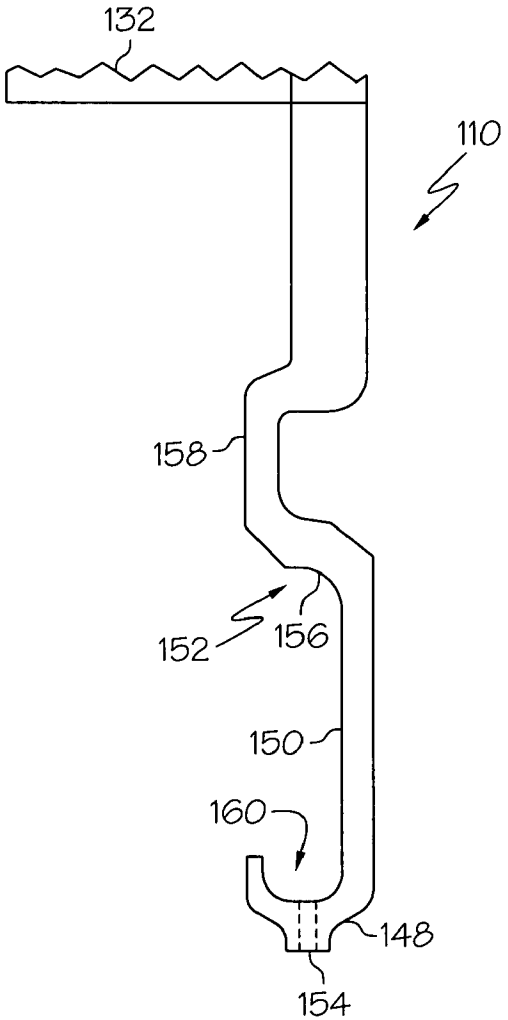
FIG. 3 is a cross-sectional view of a portion of a rotary fuel slinger used in the combustion system of FIG. 1 according to one exemplary embodiment.
Figure 4:
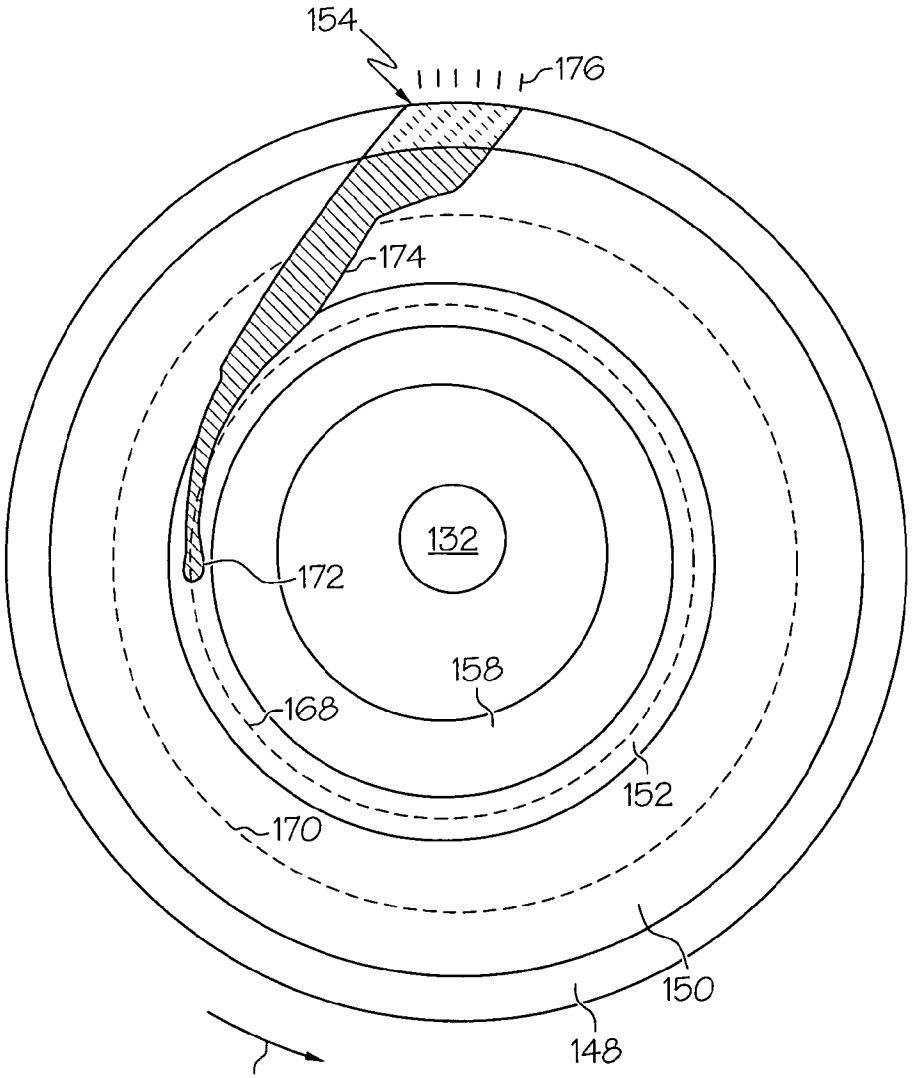
FIG. 4 is a front view of the rotary fuel slinger of FIG. 3.

FIG. 3 is a partial cross-sectional view of one exemplary embodiment of the rotary fuel slinger 110 suitable for use in the combustion system 100 of FIGS. 1 and 2, and FIG. 4 is a front view of the rotary fuel slinger 110 of FIG. 3. In the depicted embodiment, the coupler shaft 132 is generally parallel to the flow of fuel from the fuel manifold 126, and the slinger disc 134 is generally perpendicular to the coupler shaft 132. The slinger disc 134 includes a slinger portion 148 on the outer rim of the slinger disc 134, a first portion 150 radially inward of the slinger portion 148, and a second portion 152 radially inward from the first portion 150 and angled relative to the first portion 150. The angled, second portion 152 can be curved portions, straight portions, or curved and straight portions. The slinger portion 148, the first portion 150, and the second portion 152 can be integrally formed together, or formed separately and coupled together.

As best shown in FIG. 4, during typical operation, a fuel stream from the fuel manifold 126 impinges the slinger disc 134 on the second portion 152, for example at position 172 on a first radial circumference 168, during a first revolution of the slinger disc 134. The rotary fuel slinger 110 rotates in the direction indicated by arrow 178. The fuel is then centrifuged outwardly to the first portion 150 and forms a film 174 on the first portion 150. In some embodiments, even if the fuel splatters when impinging on the second portion 152, the angle of the second portion 152 can provide some momentum for the droplets of fuel toward the first portion 150 in order to rejoin and form part of the film 174. Generally, the fuel reaches a position on the first portion 150 with a second radial circumference 170 prior to a second revolution. As the slinger disc 134 continues to rotate, the fuel is then centrifuged outwardly from the first portion 150 to the slinger portion 148. The slinger portion 148 includes a plurality of holes 154 extending outwardly from the circumferential surface of the slinger disc 134. The fuel exits the slinger portion 148, and the rotary fuel slinger 110, from the holes 154 in the slinger portion 148. The slinger portion 148 can create a reservoir 160 for the fuel to collect in prior to exiting through the holes 154. As the fuel exits the holes 154 in the rotating slinger portion 148, the fuel is forced to acquire the tangential velocity of the rotary fuel slinger 110. The high fuel velocity creates a shearing force between the exiting fuel and the relatively stagnant air in the combustion system 100 surrounding the rotary fuel slinger 110. This shearing force assists in the atomization of the fuel. The atomized fuel 176 is readily evaporated and ignited in the combustor 106 (FIGS. 1 and 2).

In one embodiment, the second portion 152 includes at least one curved segment 156 that is curved towards the first portion 150. The curved segment 156 provides an impetus for the fuel to flow from the second portion 152 to the first portion 150 and assists the centrifugal forces of the rotating slinger disc 134.

As noted above, conventional rotary fuel slingers had difficulties with the fuel stream from the manifold not adhering to the rotary fuel slinger and splattering, resulting in an inability to control the fuel and an inefficient atomization. It is believed that the splattering of fuel in conventional rotary fuel slingers is a result of fuel that impinged the rotary fuel slinger during the first revolution still being at the first radial circumference when the fuel stream is provided to the rotary fuel slinger during the second revolution. Instead of impinging directly onto the rotary fuel slinger and adhering, the fuel delivered during the second revolution impinges on the fuel from the first revolution and splatters off the rotary fuel slinger. In the present invention, as noted above in reference to FIG. 4, the fuel impinges on the second portion 152 during the first revolution at the first radial circumference 168 and flows from the first radial circumference radially outward prior to a subsequent, second revolution. In the depicted embodiment of FIG. 4, the fuel flows at least to the second radial circumference 170 prior to the second revolution, although in other embodiments the fuel can flow a greater or lesser distances from the second radial circumference 170 on the first portion 150. In other embodiments, the second radial circumference 170 is on the second portion 152, although offset from the first radial circumference 168. As such, the fuel stream from the fuel manifold 126 (FIGS. 1 and 2) during the second revolution impinges directly upon the rotary fuel slinger 110 and adheres to the rotary fuel slinger 110 instead of impinging fuel from the previous revolution, which can result in the fuel splattering and separating from the rotary fuel slinger 110.

In one embodiment, the diameter of the rotary fuel slinger 110 is about 25 cm, with the diameter of the coupler shaft 132 being about 1.3 cm. The curved segment 156 of the second portion 152 can have a radius of curvature of about 0.3 cm, and positioned about 6.4 cm from the coupler shaft 132. The first portion 150 is generally substantially flat and perpendicular to the coupler shaft 132 and the flow of fuel from the fuel manifold 126, although other angles, shapes, and configurations can be provided. The width of the first portion 150 is about 2.3 cm, and the length of the first portion 150 is about 4.6 cm. A ridge portion 158 that transitions into the second portion 152 can be disposed between the second portion 152 and the coupler shaft 132. Some exemplary embodiments do not include the ridge portion 158, and the second portion 152 can be any surface that is angled relative to the first portion 150. The slinger portion 148 has a hooked cross-sectional shape with a radius of curvature of about 0.3 cm. The slinger portion 148 can be approximately 1.3 cm long and approximately 1 cm wide. The holes 154 in the slinger portion 148 can be any diameter and axial length. In one embodiment, each hole 154 has a diameter of about 0.8-1 cm and an axial length of about 0.3-0.5 cm. In one embodiment, the holes are 90° with respect to the rim of the slinger portion. In other embodiments, the holes can be oriented at 45° or 135° with respect to the rim of the slinger portion 148. Any number of holes 154 can be provided. In various embodiments, 4, 8, 16, 30, and 60 holes can be provided. In one embodiment, the surface roughness of the rotary fuel slinger 110 can be, for example, about 1.6 micrometers.

Figure 5:
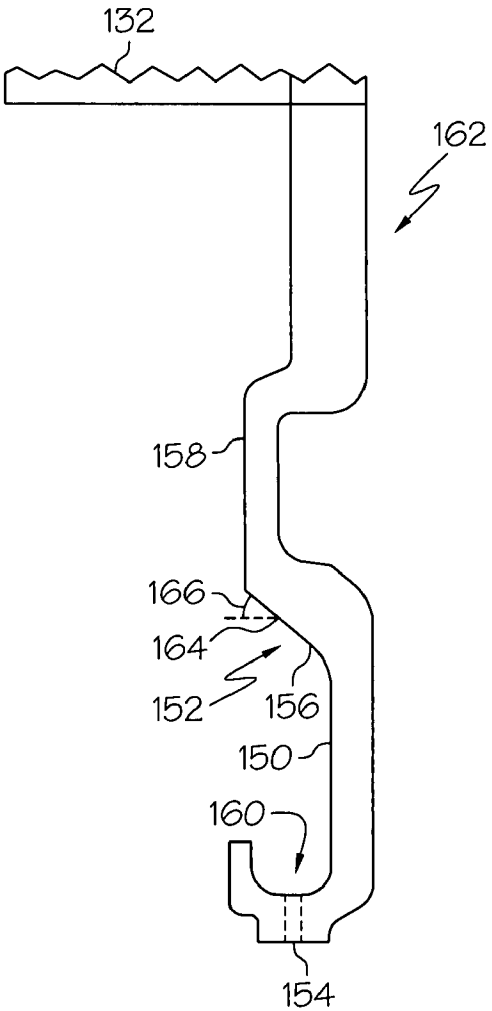
FIG. 5 is a cross-sectional view of a portion of a rotary fuel slinger used in the combustion system of FIG. 1 according to another exemplary embodiment.

FIG. 5 is a partial cross-sectional view of another embodiment of the rotary fuel slinger 162 suitable for use in the combustion system 100 of FIGS. 1 and 2. The rotary fuel slinger 162 of FIG. 5 is similar to the rotary fuel slinger 110 of FIG. 3 except that the second portion 152 of the rotary fuel slinger 110 of FIG. 5 additionally includes a straight segment 164 that transitions between the ridge portion 158 and the curved segment 156. In one embodiment, the straight segment 164 can be at an angle 166 of about 35°, although other angles can be provided, and transitions into the curved segment 156 with a radius of curvature of about 0.8 cm. Other embodiments have other angles 166, for example 45°. In an alternate embodiment, the curved segment 156 can be omitted and the straight segment 164 can extend from the ridge portion 158 to the first portion 150. The straight segment 164 can be, for example, about 0.05 cm to about 0.8 cm in length. In this embodiment, the radial length of the second portion 152 is about can be, for example, between about 0.1 cm to about 0.8 cm. In some embodiments, it can be advantageous for the fuel to impact the second portion 152 relatively close to the first portion 150.

Accordingly, improved combustion systems 100 have been provided, particularly improved combustion systems 100 with rotary fuel slingers 110, 162 that reduce splattering of the fuel stream impacting the rotary fuel slinger 110, 162. Moreover, improved methods of atomizing a flow of fuel from a fuel manifold by a rotary fuel slinger 110, 162 have been provided. While the above describes dimensions for various parts of the combustion system 100, and in particularly a rotary fuel slinger, it will be appreciated that the combustion system 100 may have any dimension suitable for a particular gas turbine engine. While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A combustion system, comprising;

a fuel manifold adapted to receive a flow of fuel from a fuel source, the fuel manifold including at least one orifice from which the received fuel is discharged;

a rotary fuel slinger disposed adjacent to the fuel manifold, the rotary fuel slinger including a coupler shaft and a slinger disc coupled to the coupler shaft, wherein the slinger disc includes a first portion disposed generally perpendicular to the coupler shaft and a second portion disposed at an angle to the first portion, wherein the fuel manifold is positioned relative to the rotary fuel slinger such that the discharged fuel impinges on the second portion, and wherein the rotary fuel slinger is configured to rotate such that the fuel is centrifuged radially outwardly from the second portion onto the first portion and subsequently off the rotary fuel slinger to atomize the fuel;

a combustor including at least a forward annular liner and an aft annular liner spaced apart from one another to form a combustion chamber therebetween that receives the atomized fuel from the rotary fuel slinger, the forward and aft radial liners each including a plurality of openings for receiving compressed air into the combustion chamber to mix with the atomized fuel; and an igniter extending at least partially into the combustion chamber and configured to ignite the atomized fuel and the compressed air mixture.

2. The combustion system of claim 1, wherein the first portion is substantially flat.

3. The combustion system of claim 1, wherein the rotary fuel slinger further includes a slinger portion with a plurality of holes extending therethrough, the slinger portion receiving the flow of fuel from the first portion and centrifuging the flow of fuel out of the holes in the slinger portion.

4. The combustion system of claim 1, wherein the second portion couples the coupler shaft to the first portion.

5. The combustion system of claim 1, wherein the coupler shaft is disposed generally parallel to the flow of fuel.

6. The combustion system of claim 1, wherein the rotary fuel slinger is configured such that the flow of fuel impinges upon the second portion at a first radial circumference during a first revolution and flows radially outwardly from the first radial circumference prior to the beginning of a second revolution.

7. The combustion system of claim 1, wherein the second portion has a curved segment.

8. The combustion system of claim 7, wherein the curved segment has a radius of curvature of about 0.3 cm.

9. The combustion system of claim 7, wherein the curved segment has a radius of curvature of about 0.8 cm.

10. The combustion system of claim 1, wherein the second portion has a straight segment.

11. The combustion system of claim 1, wherein the second portion has a straight segment at an angle of about 35° with respect to the coupler shaft.

12. The combustion system of claim 1, wherein the second portion has a straight segment at an angle of about 45° with respect to the coupler shaft.

13. The combustion system of claim 1, further comprising a fuel drip guide coupled to the fuel manifold.

14. A rotary fuel slinger utilized in a combustion system having a fuel manifold, comprising:

a coupler shaft; and a slinger disc disposed on the coupler shaft, the slinger disc including a first portion disposed generally perpendicular to the coupler shaft and a second portion at an angle relative to the first portion, the second portion configured to receive a flow of fuel from the fuel manifold such that the flow of fuel is centrifuged radially outwardly from the second portion onto the first portion and subsequently off the rotary fuel slinger to atomize the received fuel, wherein the rotary fuel slinger is configured such that the flow of fuel impinges upon the second portion at a first radial circumference during a first revolution and flows radially outwardly from the first radial circumference prior to a second revolution.

15. The rotary fuel slinger of claim 14, wherein the second portion includes a straight segment or a curved segment.

16. The rotary fuel slinger of claim 15, wherein the straight segment is at an angle of about 35° relative to an axis of the coupler shaft.

17. The rotary fuel slinger of claim 14, wherein the second portion has a curved segment with a radius of curvature is at least 0.3 cm.

* * * * *